US006033247A

United States Patent [19]

Gregory, II

[11] Patent Number: 6,033,247

[45] Date of Patent: Mar. 7, 2000

[54] AXIALLY ADJUSTABLE CONNECTOR

[75] Inventor: Jonathan Mark Gregory, II, Ann Arbor, Mich.

[73] Assignee: Yazaki Corporation, Japan

[21] Appl. No.: 09/103,915

[22] Filed: Jun. 24, 1998

[51] Int. Cl.[7] ..... H01R 13/64

[52] U.S. Cl. ..... 439/248; 439/247

[58] Field of Search ..... 439/246, 247, 439/248, 552, 556, 559, 553

[56] References Cited

U.S. PATENT DOCUMENTS

| | | | |
|---|---|---|---|
| 3,562,696 | 2/1971 | Barnhart et al. | 439/248 |
| 5,580,263 | 12/1996 | Kourimsky | 439/248 |
| 5,873,746 | 2/1999 | Morlion et al. | 439/248 |

*Primary Examiner*—Michael L. Gellner
*Assistant Examiner*—Antoine Ngandjui
*Attorney, Agent, or Firm*—Young & Basile, P.C.

[57] ABSTRACT

A floating connector assembly allowing for axial movement of joined wire harness terminal connectors as a unit, thereby preventing rubbing and wear of their electrical contacts or terminals. The floating connector assembly comprises a first connector having electrical terminals and a spring-receiving surface, and a spring bracket assembly which secures the first connector to a fixed surface on a vehicle with axial spring force greater than a terminal-connecting force between mating electrical terminals of the first connector and a second connector. A bellows-type seal designed to accommodate the axial spring compliance of the connector is also disclosed. The spring bracket assembly is loaded into a compressed state when the second connector is placed in a final position by a mounting surface or electrical device. Forces tending to loosen or disengage the mated electrical terminals of the first and second connectors are absorbed by the spring bracket assembly.

14 Claims, 5 Drawing Sheets

FIG-5
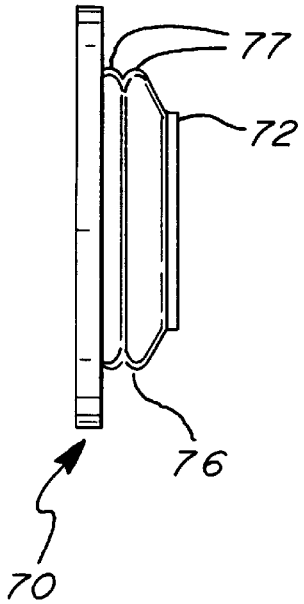
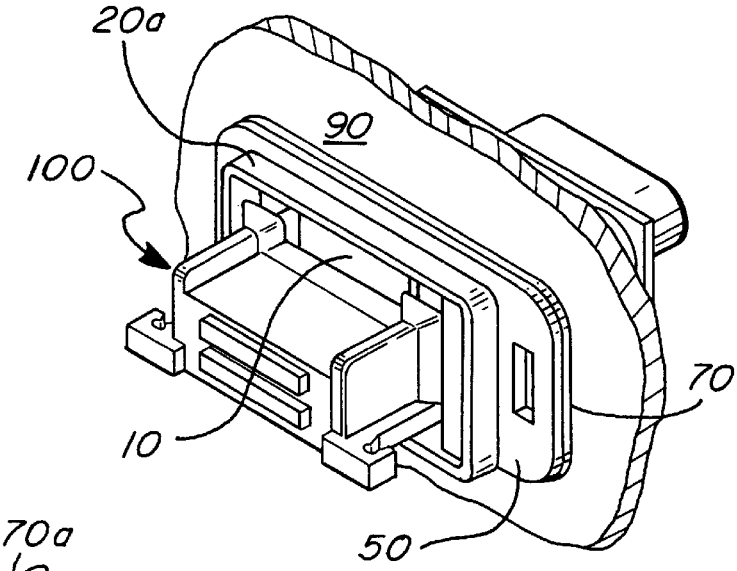
FIG-7
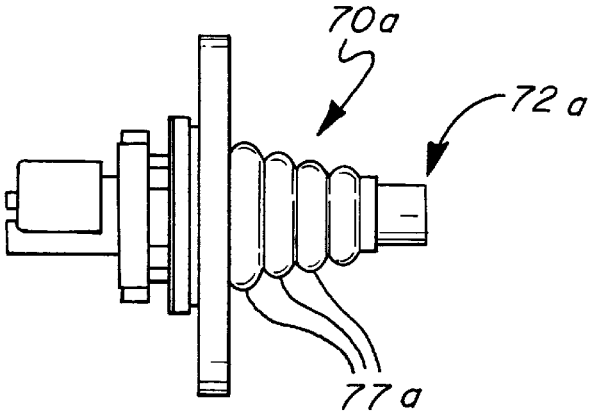
FIG-8
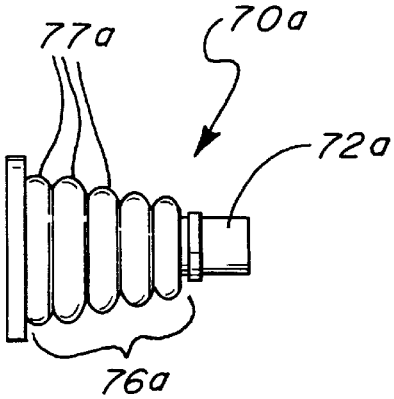
FIG-9

AXIALLY ADJUSTABLE CONNECTOR

FIELD OF THE INVENTION

The present invention is in the field of wire harness terminal connectors of the type used in vehicles, in particular male and female terminal connectors whose contacts are subject to wear and disengagement due to movement of their respective mounting surfaces.

BACKGROUND

It is known in the vehicle wiring harness art to use "floating" connectors, wherein a male or female connector is mounted to a fixed surface with a degree of flotation to accommodate movement of the mating connector. For example, it is typical to mount a female power supply connector to the door jamb of a vehicle, while a male connector which supplies power to door-mounted controls extends from the door to plug into the female connector in the door jamb. The door jamb is a relatively fixed surface, while the male connector's mounting to the movable door is generally less stable. It is known to mount the female connector in a bracket in the door jamb such that it "floats" with limited compliance in the x-y plane of the door jamb to accommodate male connector motion caused by vibration and door movement. Other uses for floating connectors include terminal connections between the vehicle door frame and door panels, which can flex and vibrate relative to the frame, and terminal connections between self-contained electrical devices such as vehicle radios and the dashboards or other mounting panels into which they are plugged. However, prior art floating connectors of the type described above have experienced problems with terminal wear and accidental terminal disengagement due to movement of the male connector in the axial mating (z-axis) direction, movement which the prior art female connector mounting arrangement is not designed to accommodate.

SUMMARY

The present invention is a floating connector assembly which provides mating direction (z-axis) spring compliance between a first connector and the fixed surface in which it is mounted, the spring compliance absorbing forces tending to loosen or disengage mating electrical terminals of the first connector and a second connector attached to a movable or less stable surface.

In a first embodiment of the invention, the connector mounted to the fixed surface with the inventive bracket uses a multiple coil spring and intermediate retention bracket structure to mount the connector on the fixed surface with z-axis compliance.

In a second embodiment of the invention, a multiple-leaf leaf spring riding in a track formed in the main bracket is used, eliminating the need for an intermediate retention bracket.

A novel bellows type wire harness seal is also disclosed for use with the bracket of the present invention to seal the wire harness.

These and other features and advantages of the present invention will become apparent upon a further reading of the specification, in light of the accompanying drawings.

BRIEF DESCRIPTION OF THE DRAWINGS

FIG. 5 is a side view of the wire harness seal shown in FIG. 1;

FIG. 7 is a respective view of the embodiment of FIG. 7, assembled;

FIG. 8 is a side view of FIG. 7; and

FIG. 9 is a side view of a wire harness seal used in the embodiment of FIG. 7.

DETAILED DESCRIPTION OF THE DRAWINGS

Figure 1:
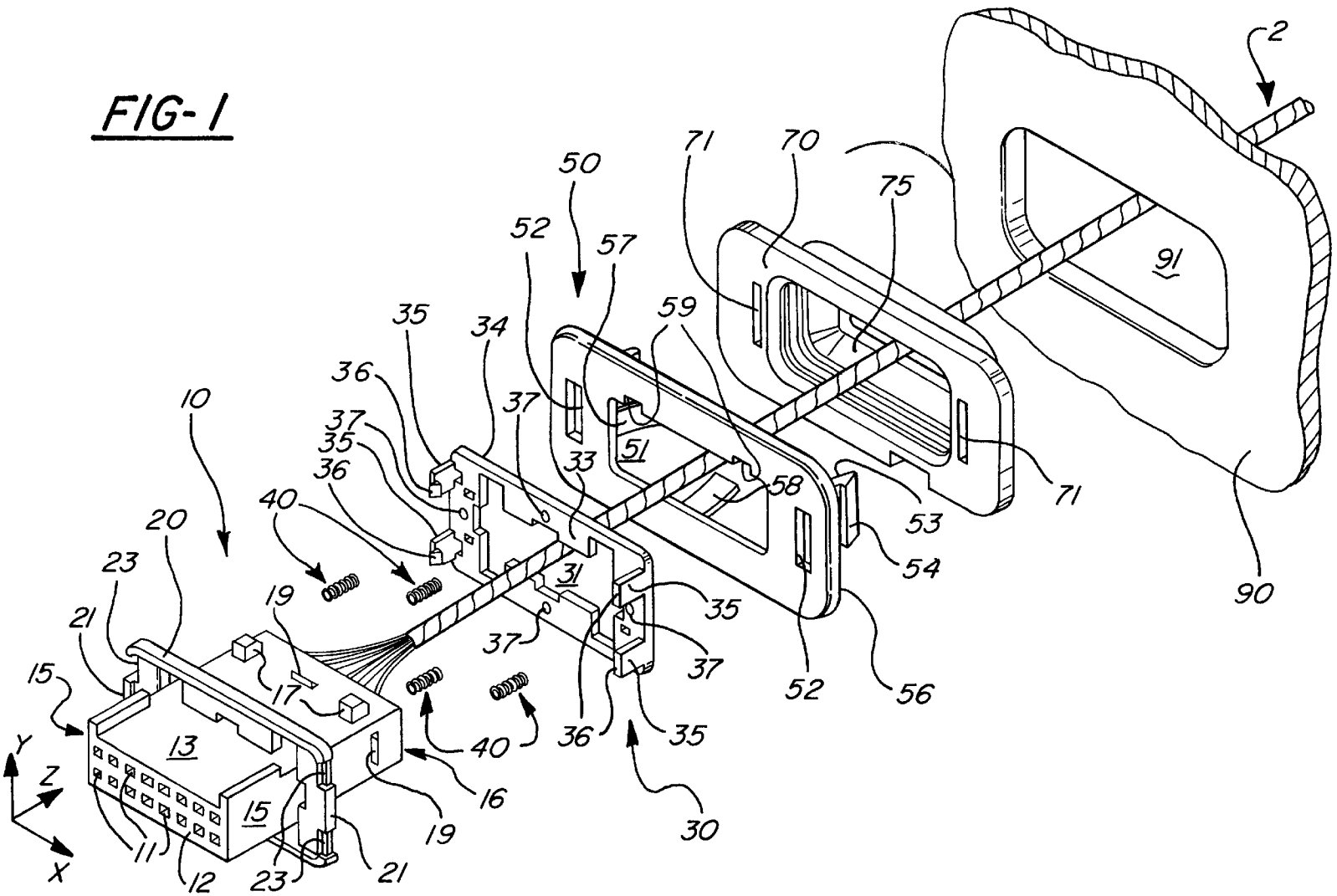
FIG. 1 is an exploded perspective view of a first embodiment of the present invention.
Figure 2:
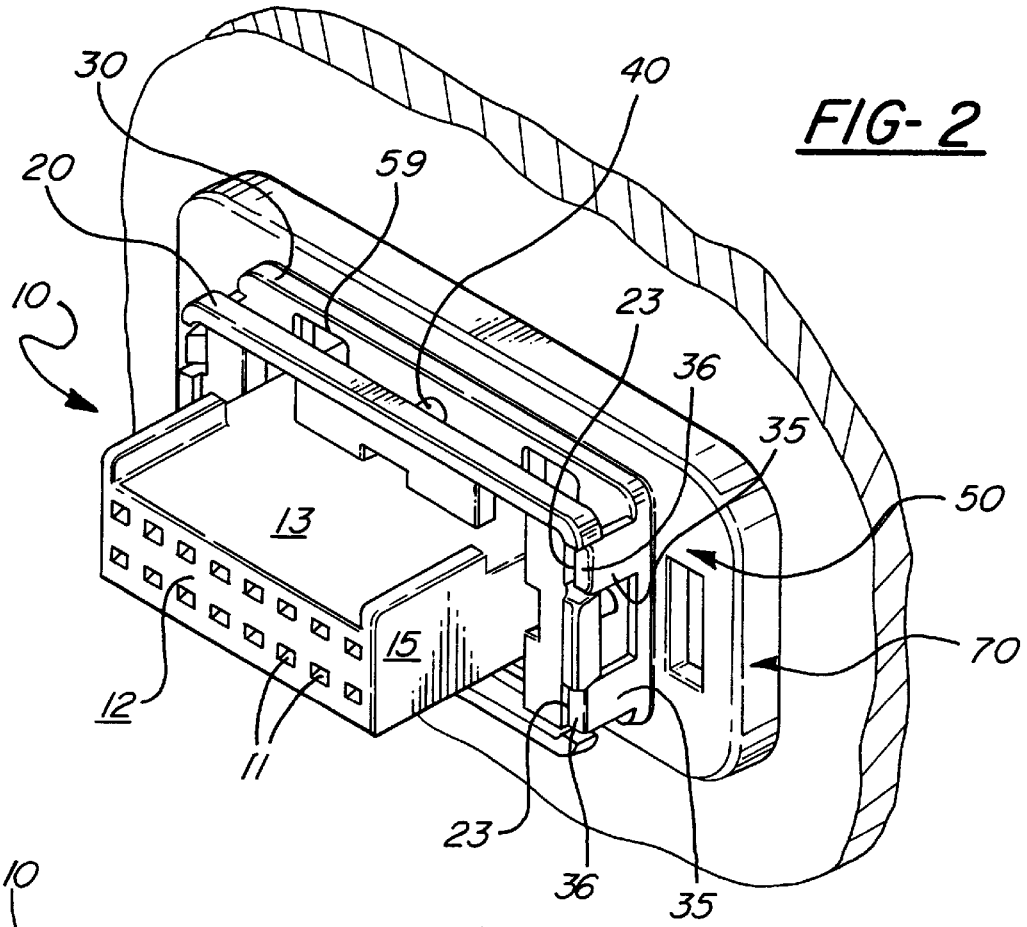
FIG. 2 is a perspective view of the embodiment of FIG. 1, assembled and mounted on a fixed surface representing an automotive door jamb.
Figure 3:
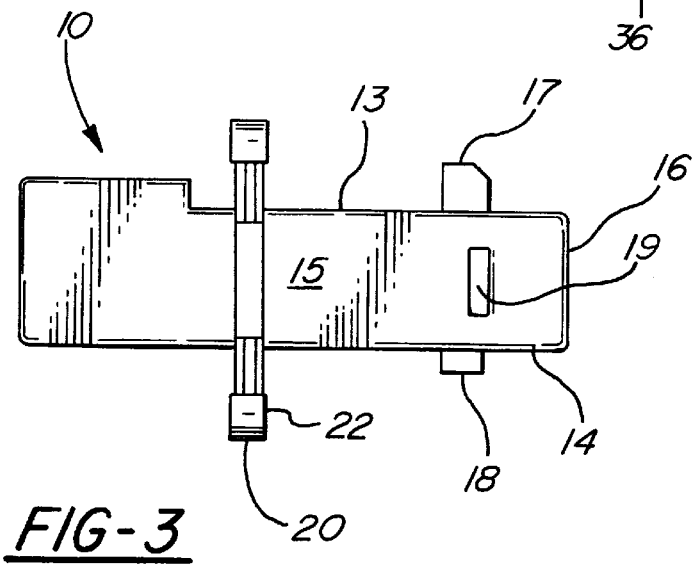
FIG. 3 is a side view of a wire harness terminal connector used in both embodiments of the present invention.
Figure 4:
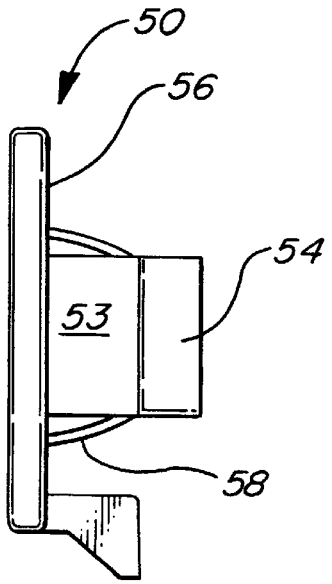
FIG. 4 is a side view of the mounting bracket of FIG. 1.
Figure 6:
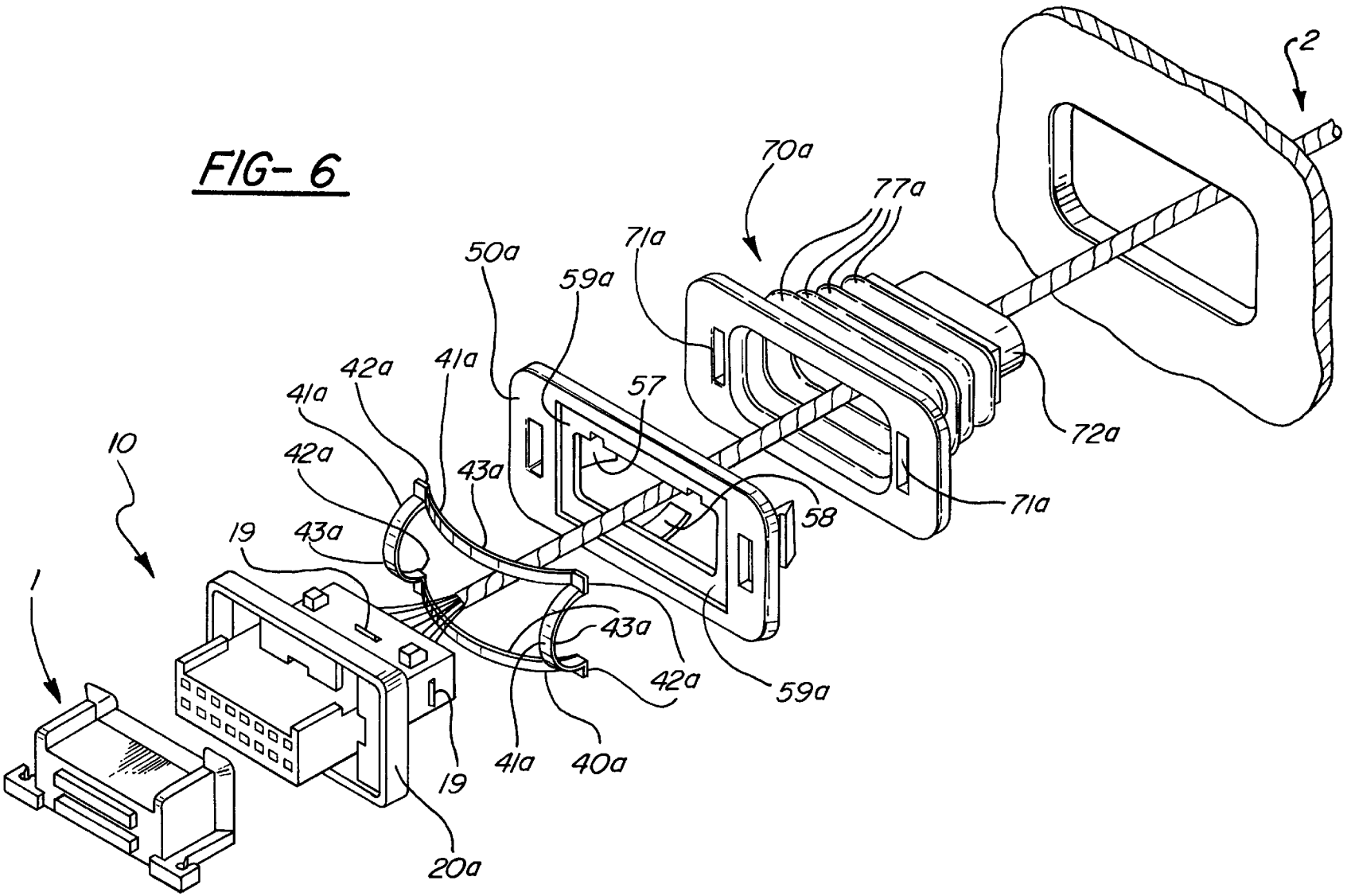
FIG. 6 is an exploded perspective view of a second embodiment of the present invention using a one-piece spring.

Referring now to FIGS. 1, 2, and 3, a female connector 10 is illustrated having a plurality of terminal chamber openings 11 on its front surface 12 to receive a male connector 1 (shown in FIG. 6). Although a female connector is illustrated in FIG. 1, the invention can also be used with a male connector. Connector 10 is a hollow, box-like plastic structure having top surface 13, bottom surface 14, side surfaces 15 and a rear opening 16 through which wires comprising a wire harness 2 are inserted and connected to electrical contacts (not shown) in chambers 11. Top surface 13 preferably includes guide blocks 17 to prevent inverted insertion of connector 10 into brackets described below. Bottom surface 14 preferably includes similar guide blocks 18 (See FIG. 3) having different dimensions or spacing. In the preferred embodiment, a stop 19 is located on top 13, bottom 14, and side surfaces 15. As will be described fully below, the stops prevent connector 10 from being withdrawn from a mounting bracket.

Connector 10 is encompassed by an outer bracket 20 which may be a separate component attached to connector 10, but is preferably integrally molded with connector 10. Outer bracket 20 has sides 21 and rear surface 22 (FIG. 3). Sides 21 have recesses 23 to engage a retention bracket described below. The illustrated embodiment shows two recesses per side, although someone skilled in the art may vary the number and location of recesses 23.

Referring to FIGS. 1 and 2, connector 10 is connected by its outer bracket 20 to a retention bracket 30 whose pawls 36 engage recesses 23. Retention bracket 30 has an opening 31 sized and notched to allow connector 10 with guide blocks 17 and 18 and stops 19 to be inserted until outer bracket 20 is snap-fit into retention bracket pawls 36. Locking arms 35 on retention bracket 30 are positioned such that as connector 10 is inserted through opening 31, pawls 36 lock onto recesses 23 on the outer bracket 20, thereby preventing connector 10 from accidentally being pulled free from retention bracket 30. Connector 10 is free to move axially (in the direction of wire harness 2) relative to retention bracket 30 between pawls 36 and "front"-facing retention bracket surface 33.

Compression springs 40 are located in recesses 37 on front surface 33 of retention bracket 30 to engage spring-receiving positioning structure such as identical recesses (not shown) on rear surface 22 of outer bracket 20. The illustrated embodiment shows a preferred arrangement of four coil springs, one per side for balance, but it will be understood that the number of springs can vary. It will also be understood by those skilled in the art that while an outer bracket 20 is the preferred spring-receiving structure illustrated in the drawings, connector 10 can be formed with various integral or add-on spring-receiving portions or surfaces suitable for use with the invention.

When connector 10 and retention bracket 30 have been assembled as described above, the rear portion 16 of connector 10 is inserted through a mounting bracket 50 having an opening 51 sized to receive connector 10 up to retention bracket 30. Notches 59 are sized to admit connector guide blocks 17 for proper connector orientation. Locking arms 53 extend from the rear surface of mounting bracket 50, each locking arm 53 having a pawl 54 to lock mounting bracket 50 onto a fixed surface 90. The illustrated embodiment uses two locking arms, although a different number of locking arms is possible. In the illustrated embodiment, fixed surface 90 represents an automobile door jamb.

Mounting bracket 50 also includes resilient support tabs 57 and 58 extending rearwardly from the bracket, in the illustrated embodiment a total of four tabs: top, bottom and sides. As the rear portion 16 of connector 10 is inserted through mounting bracket opening 51, connector stops 19 cause tabs 57, 58 to flex outwardly until the stops are past the tabs. At that point, resilient tabs 57, 58 snap back over stops 19, locking the connector/spring/retention bracket assembly in place in mounting bracket 50, with connector 10 held against tabs 57, 58 under tension from springs 40. Removing the connector from mounting bracket 50 requires flexing the resilient support members 57, 58 out of engagement with stops 19. Opening 51 is preferably sized to allow the connector/spring/retention bracket assembly to move horizontally, vertically, and rotationally in the x-y plane of mounting bracket 50, accommodated by the resilient nature of tabs 58, 59.

FIGS. 1, 2, and 5 illustrate a seal 70 providing a watertight bellows-type seal sandwiched between mounting bracket 50 and an opening 91 in door jamb 90, thereby sealing rear connector portion 16 and wire harness 2 from the environment. Slots 71 on the surface of seal 70 permit mounting bracket lock arms 53 to pass through the seal with a watertight fit and to latch onto the rear surface of door jamb 90, sandwiching the outermost portion of seal 70 therebetween.

In a second embodiment of the invention illustrated in FIGS. 6 through 9, connector 10 is similar to that shown in the first embodiment of FIGS. 1–5. However, the individual coil springs 40 in the embodiment of FIGS. 1–5 have been replaced with a leaf spring 40*a* having four feet 42*a* and four arcuate spring legs 41*a*, each leg having a central apex 43*a*. Leaf spring 40*a* is preferably made out of metal, but may be made out of other known spring materials.

The apex of each spring leg 41*a* fits into a track (not shown) in rear surface 22 of connector bracket 20*a*. The width and length of the track is such that legs 41*a* can slide back and forth, giving bracket 20*a* a limited degree of x-y motion on spring 40*a*. Feet 42*a* fit into an opposing track 59*a* in mounting bracket 50*a* which secures feet 42*a* in the x-y direction on mounting bracket 50. For purposes of illustration, the track for spring legs 41*a* on the rear surface 22 of outer bracket 20*a* may be identical to track 59*a* in mounting bracket 50*a*.

The mating fit between spring legs 41*a* and the track on the rear surface of outer bracket portion 20*a*, and the fit of spring feet 42*a* in the opposite track 59*a* and mounting bracket 50*a*, eliminates the need for spring retention bracket 30 used in the FIG. 1 embodiment. The outward bias force of leaf spring 40*a* on bracket 20*a* is similar to that given by coil springs 40 in FIGS. 1–5, and provides z-axis spring compliance as illustrated in FIGS. 6A–6C.

FIGS. 8 and 9 illustrate an improved bellows-type seal 70*a* which is interchangeable with seal 70 shown in the first embodiment of FIGS. 1–5. A distinguishing feature of seal 70*a* is the individual bellows portions 77*a* on intermediate section 76*a*, decreasing in size from the front to the rear and providing additional z-axis compliance with the movement of connector 10 and wire harness 2. Grip section 72*a* is designed to snugly and securely grip the bundle of wires that make up the wire harness. Seal 70*a* contains slots 71*a* to allow lock arms 53 and pawls 54 to pass therethrough and secure bracket 50 to fixed surface 90 as in the first embodiment described above.

The remainder of the components of the embodiment of FIGS. 6–9 function as described in the embodiment of FIGS. 1–5.

Figure 6A:
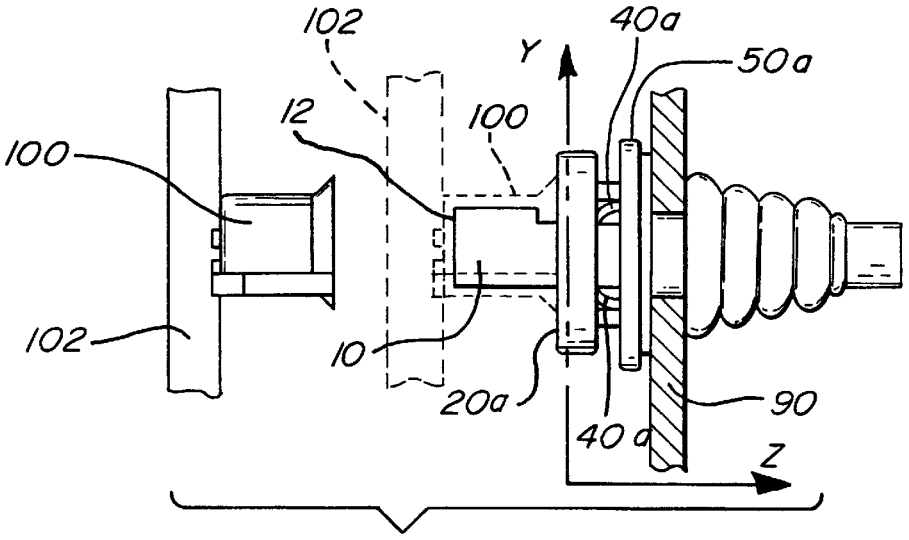
FIGS. 6A–6C illustrate the operation of the embodiment of FIG. 6 when a second connector is mated with the first connector of FIG. 6.
Figure 6B:
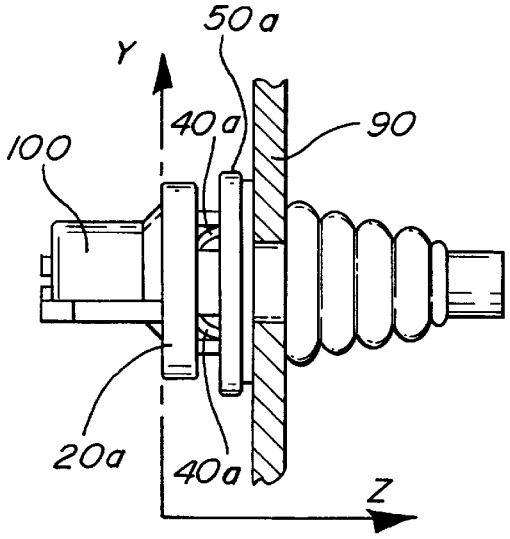
Figure 6C:
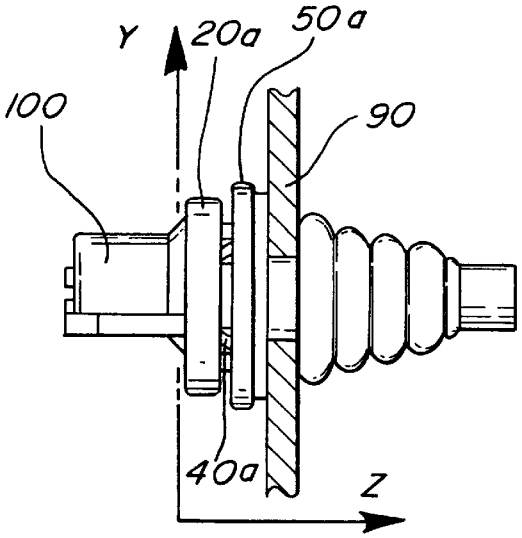

Referring now to FIGS. 6A through 6C, a mounting surface or an electrical device 102 such as a door panel, radio or printed circuit board has a built-in male connector portion 100 adapted to be inserted into the terminal chamber openings 11 in the front end 12 of female connector 10 while the female connector is secured to a fixed surface 90 by the bracket, spring and seal mounting arrangement described above in FIGS. 6 through 9.

In FIG. 6A, the female connector 10 is held in a negative z-axis position away from fixed surface 90 by the force of spring 40*a* pressing against outer connector bracket 20*a*. Mounting bracket 50*a* secured to surface 90 acts as a fixed point of reference for the female connector 10.

As the male connector 100 is inserted into female connector 10, flanges on the connector tend to move female connector 10 in the x-y directions for proper connector alignment before the terminals can be fully inserted. The x-y movement is permitted by the flexible nature of mounting bracket tabs 57, 58 ( FIG. 6) and the relative dimensions of the rear portion 16 of female connector 10 and opening 51 in the mounting bracket. This x-y movement of the female connector is additionally aided by the sliding, flexible spring connection 40*a* between the female connector and mounting bracket 50*a*. At this insertion of the male connector into the female connector shown in broken lines in FIG. 6A, they are in full electrical and mechanical connection but there is little or no movement of the female connector in the z-axis direction due to the force of spring 40*a*. Spring 40*a* begins to compress to the neutral z-axis (z=0) position shown in FIG. 6B only as the male connector is pushed further toward the female connector, for example when the panel, surface or device on which the male connector is mounted is moved to its final assembled position.

Since the force of spring 40*a* is selected to be more than the force needed for full terminal connection between the male and female connectors, the spring is not significantly compressed as the connectors are mated. The spring enters a loaded or compressed state only after the male connector's mounting surface is finally positioned as shown in FIG. 6B. At the same time, the compliance of the spring in the loaded or compressed state is such that it absorbs or yields to forces tending to loosen or disengage the mated connector terminals. The result is that any future z-axis changes in the location between the male connector's mounting surface and the female connector's bracket mounting surface 90 will result in the spring displacing the female connector relative to the mounting bracket, such that the mated terminals inside the male and female connectors remain in constant contact without wear or rubbing. Accordingly, play between the male connector's mounting surface and fixed surface 90, such as occurs due to vehicle vibration and/or movement between the portions of the vehicle across which the connectors establish an electrical path, is accommodated by the mated connectors as a unit due to the spring-bracket mounting of female connector 10 to surface 90. FIG. 6C illustrates z-axis displacement of male connector 100 toward surface 90, with spring 40*a* responding to allow the mated connectors to move as a unit.

It will be understood that the embodiment of the invention illustrated in FIG. 1, using four springs 40 rather than a leaf spring 40*a*, produces a z-axis spring-compliance in the mated connectors substantially the same as that shown in FIGS. 6A–6C.

The foregoing description sets forth a number of illustrated embodiments of the present invention and is not intended to be limiting, as modifications and variations of the invention within the scope of the appended claims will be possible for those skilled in the art now that specific embodiments have been made known.

Accordingly, I claim:

1. A floating connector assembly comprising:

a first connector having a wire harness end adapted to receive electrical wires, and a terminal mating end adapted to receive a second connector in axial mating connection, the first connector including a spring-receiving surface;

a spring bracket assembly comprising a mounting bracket adapted to be secured to a surface such as a vehicle body panel in a fixed position, a plurality of axial compression springs, and a retention bracket for retaining the springs in a position to be received by the spring-receiving surface on the first connector when the wire harness end of the connector is inserted into the mounting bracket, the retention bracket adapted to receive the springs and further including lock arms adapted to mechanically lock the retention bracket to the first connector with the springs compressed therebetween, the lock arms having a length allowing axial movement of the spring-loaded first connector relative to the retention bracket, the mounting bracket further including an opening for receiving the wire harness end of the first connector and means for securing the wire harness end of the first connector when the wire harness end is inserted through the opening, such that the first connector is free to move axially relative to the mounting bracket under spring force from the springs tending to push the first connector axially away from the mounting bracket.

2. The apparatus of claim 1, wherein the spring force of the springs is selected to be more than a terminal-connecting force between mating electrical terminals on the first and second connectors, and the compliance of the springs is such that they absorb or yield to a terminal-loosening force tending to loosen or disengage mating terminals, whereby the springs prevent significant movement of the first connector while the terminals are being mated and prevent movement of the mated connectors relative to one another such that they move as a unit without loosening the mated terminals.

3. The apparatus of claim 1, wherein the mounting bracket has a front face adapted to receive the retention bracket in a sliding face-to-face fit.

4. The apparatus of claim 3, wherein the retention bracket includes an opening adapted to receive the wire harness end of the first connector therethrough to engage the connector securing means on the mounting bracket.

5. The apparatus of claim 4, wherein the wire harness end of the first connector includes guide blocks and the retention bracket and mounting bracket include complementary alignment notches in their wire harness end openings to receive the guide blocks therethrough when the wire harness end is properly aligned with the brackets.

6. The apparatus of claim 1, wherein the spring force is designed to place the first connector in a negative z-axis position away from the mounting bracket, and to hold the first connector in the negative z-axis position when the second connector is mated to the first connector, the spring force being further selected such that the mated first and second connectors are able to move as a unit on the z-axis relative to the mounting bracket without causing movement between their mated electrical terminals.

7. The apparatus of claim 6, wherein the spring force is designed to place the mated first and second connectors in a neutral z-axis position when the second connector is placed in a final assembled mounting position by a mounting surface or device.

8. A floating connector assembly comprising:

a first connector having a wire harness adapted to receive electrical wires, and a terminal mating end adapted to receive a second connector in axial mating connection, the first connector including a spring-receiving surface;

a spring bracket assembly comprising a mounting bracket adapted to be secured to a surface such as a vehicle body panel in a fixed position, a leaf spring having feet adapted to fixedly engage the mounting bracket and outwardly curved spring legs adapted to slidingly engage the spring-receiving surface on the first connector, and spring-retention means on the mounting bracket for retaining the leaf spring on the mounting bracket in a position to be engaged by the spring-receiving surface on the first connector when the wire harness end of the connector is inserted into the mounting bracket, the mounting bracket further including an opening for receiving the wire harness end of the first connector and means for securing the wire harness end of the first connector when the wire harness end is inserted through the opening, such that the first connector is free to move axially relative to the mounting bracket under spring force from the leaf spring tending to push the first connector axially away from the bracket.

9. The apparatus of claim 8, wherein the spring force of the axial spring means is selected to be more than a terminal-connecting force between mating electrical terminals on the first and second connectors, and the compliance of the spring is such that it absorbs or yields to a terminal-loosening force tending to loosen or disengage mating terminals, whereby the spring means prevents significant movement of the first connector while the terminals are being mated and prevents movement of the mated connectors relative to one another such that they move as a unit without loosening the mated terminals.

10. The apparatus of claim 8, wherein the spring-receiving surface on the first connector comprises a track adapted to receive portions of the spring legs in a sliding fit.

11. The apparatus of claim 10, wherein the leaf spring is generally rectangular in shape, comprising two horizontal curved legs and two vertical curved legs.

12. The apparatus of claim 8, wherein the spring force is designed to place the first connector in a negative z-axis position away from the mounting bracket, and to hold the first connector in the negative z-axis position when the second connector is mated to the first connector, the spring force being further selected such that the mated first and second connectors are able to move as a unit on the z-axis relative to the mounting bracket without causing movement between their mated electrical terminals.

13. The apparatus of claim 12, wherein the spring force is designed to place the mated first and second connectors in a neutral z-axis position when the second connector is placed in a final assembled mounting position by a mounting surface or device.

14. A floating connector assembly comprising:

a first connector having a wire harness end adapted to receive electrical wires, and a terminal mating end adapted to receive a second connector in axial mating connection, the first connector including a spring-receiving surface;

a spring bracket assembly comprising a mounting bracket adapted to be secured to a surface such as a vehicle body panel in a fixed position, axial spring means, and spring-retention means for retaining the axial spring means in a position to be received by the spring-receiving surface on the first connector when the wire harness end of the connector is inserted into the mounting bracket, the mounting bracket further including an opening for receiving the wire harness end of the first connector and means for securing the wire harness end of the first connector when the wire harness end is inserted through the opening, such that the first connector is free to move axially relative to the mounting bracket under spring force from the axial spring means tending to push the first connector axially away from the bracket, further including a bellows type seal member adapted to be sandwiched between the spring bracket assembly and the fixed surface, the seal member having an interior end adapted to sealingly engage a wire harness connected through the spring bracket assembly to the wire harness end of the first connector, and an axially-compliant bellows portion adapted to accommodate the axial motion of the first connector relative to the spring bracket assembly.

* * * * *

UNITED STATES PATENT AND TRADEMARK OFFICE

CERTIFICATE OF CORRECTION

PATENT NO : 6,033,247

DATED : March 7, 2000

INVENTOR(S) : Gregory, II

It is certified that error appears in the above-identified patent and that said Letters Patent are hereby corrected as shown below:

Col. 2, line 13, delete "respective" and insert –perspective–;

Signed and Sealed this

Third Day of April, 2001

*Attest:*

NICHOLAS P. GODICI

*Attesting Officer*

*Acting Director of the United States Patent and Trademark Office*